US006084052A

United States Patent [19]

Aufdermarsh et al.

[11] Patent Number: 6,084,052

[45] Date of Patent: Jul. 4, 2000

[54] USE OF POLYARYLETHERKETONE-TYPE THERMOPLASTICS IN DOWNHOLE TOOLS

[75] Inventors: Carl Aufdermarsh, Asheville, N.C.; Monib M. Monib, Newark, Del.; Stanley R. Thomas, Houston, Tex.

[73] Assignee: Schlumberger Technology Corporation, Houston, Tex.

[21] Appl. No.: 09/026,218

[22] Filed: Feb. 19, 1998

[51] Int. Cl.[7] ..... V08G 8/02; V08G 14/00

[52] U.S. Cl. ..... 528/125; 528/220; 528/425; 156/160; 156/175; 156/272.2; 156/327; 156/379.6; 73/152.1; 73/152.78; 250/580; 166/386

[58] Field of Search ..... 528/125, 220, 528/425; 156/160, 175, 272.2, 327, 379.6; 73/152.1, 152.78; 250/580; 166/386

[56] References Cited

U.S. PATENT DOCUMENTS 4,320,224 3/1982 Rose et al. ..... 528/125
4,714,509 12/1987 Gruber .
4,816,556 3/1989 Gay et al. .
5,160,561 11/1992 Gruber .
5,160,568 11/1992 Gruber .
5,363,929 11/1994 Williams et al. ..... 175/107
5,871,052 2/1999 Benson et al. ..... 166/386

FOREIGN PATENT DOCUMENTS 0307215 3/1989 European Pat. Off. .
0463611 2/1992 European Pat. Off. .

*Primary Examiner*—Duc Truong
*Attorney, Agent, or Firm*—John J. Ryberg; Brigitte L. Jeffery

[57] ABSTRACT

The present invention relates generally to the use of polyaryletherketone-based thermoplastic materials in the fabrication of logging tools employed in high pressure, high temperature, downhole logging applications. A polyaryletherketone resin bonded with glass fibers is formed into a housing for the logging tool. The housing is constructed by any of the following processes: filament winding or compression molding. When used with a logging tool, the housing encloses the operative components of the logging tool, such as sensors and sources, and protects the operative components from borehole fluids.

25 Claims, 3 Drawing Sheets

USE OF POLYARYLETHERKETONE-TYPE THERMOPLASTICS IN DOWNHOLE TOOLS

BACKGROUND OF THE INVENTION

This invention concerns the fabrication and use of polyaryletherketone-based thermoplastic materials in the fabrication of oil field tools employed in downhole logging applications. By way of background, downhole logging tools are exposed to difficult environmental conditions. The average depth of wells drilled each year becomes deeper and deeper, both on shore and off shore. As the wells become deeper, the operating pressures and temperatures become higher. The open or uncased hole involves the cutting of a circular well borehole through the subsurface formations. After the drill bit has passed through each strata, it leaves a fairly rough, even abrasive surface. While the abrasive nature is reduced by the accumulation of a mud cake on the sidewall, the repeated travel of a logging tool along the well borehole produces abrasive wear. In addition, they are more often than not inclined from the vertical which leads to a substantial amount of abrasive wear on the logging tools. Logging tools are lowered into a well borehole, moved to the very bottom of the well, and then retrieved. This traverse of the full length of the well exposes the logging tool to abrasive contact with the open hole.

Drilled wells can be extremely aggressive environments. Boreholes are often rugose and tend to be abrasive. Drilling muds, which are used to facilitate drilling, contain chemical additives which can degrade non-metallic materials. They are highly caustic with a pH ranging as high as 12.5. Other well fluids may include salt water, crude oil, carbon dioxide and hydrogen sulfide which are corrosive to many materials.

Downhole conditions progressively become more hostile as depth increases. At depths of 5,000 to 8,000 meters, bottom hole temperatures (BHT) of 260° C. and pressures of 170 MPa are often encountered. This exacerbates degradation of exposed logging tool materials.

These deep well conditions of high pressure and high temperature (HPHT below) damage the external or exposed logging tool components. Internal electronics need to be protected from heat and external housings need to be upgraded. The most vulnerable materials are the plastic and composite materials which are exposed to caustic drilling mud and other corrosive well fluids. Some tools, such as those making electrical induction and magnetic resonance measurements, require these non-conductive, non-magnetic materials of construction in order to function properly. This requires materials which are essentially transparent to electromagnetic radiation and have magnetic permeability of 1.

Ceramics generally are too brittle, i.e., a sharp impact may fracture the ceramic. The present disclosure sets forth a composite material system which is formed into the shell defining a downhole logging tool, and more particularly one which can operate at the prevailing BHT of 260° or greater. It enables the construction of an elongate cylindrical sleeve and connected, end located subs which comprises the major portion of the housing, as well as other non metallic parts. The completed tool housing, and the contents within that housing are thus protected. On the interior, a pressure balance typically is achieved by raising the interior pressure inside the tool to approximate that on the exterior. Deep wells encounter pressures as high as 170 MPa or higher.

Conventional plastics such as epoxies and phenolics perform adequately in conditions up to about 180° C. and 100 MPa. Under more extreme conditions however they fail prematurely. Many alternative materials have been evaluated and rejected for various reasons. For example, polyimides, polyetherimide ("ULTEM"), and polyamideimide ("TORLON") are well known for their excellent durability at high temperature. They, too, fail however in well fluids because their imide and amide linkages are subject to rapid hydrolytic degradation at high pH. Polyphenylene sulfide is water resistant but its crystalline melting point, 260° C., is too low for this application.

One class of material, polyaryletherketones, meets the demanding thermal and chemical requirements for this application. It has the desired high pressure, high temperature (HPHT) performance characteristics, and is also impervious to chemical attack by well and formation fluids. It provides structural rigidity and strength at HPHT conditions even in the presence of chemically active materials. For instance, there is always the risk of $H_2S$ invasion in a deep well. The shell of the subject invention is impervious to $H_2S$. Moreover, it is both tough and resilient so that abrasive contact during movement in the well borehole does not damage or otherwise harm the apparatus. Finally, the apparatus is well able to enclose all the sensing components of an induction logging tool. The novel shell is substantially transparent to signal transmission from the logging tool and response from the formation.

The present disclosure includes a sleeve which defines the housing for a logging tool supported both on a drill stem and wireline. Successful downhole housing shells, end connected subs, and a variety of other parts are made of polyaryletherketone based thermoplastic materials to operate at HPHT conditions.

SUMMARY OF THE INVENTION

The shell of the present disclosure is formed of a composite filament material. An induction logging tool shell is built from multiple plies of continuous filament wrapped around a mandrel. It is formed of a desired number of plies which are wrapped with a helical angle. Plies are wrapped both with practically no lead angle and also with changing angular bias to provide structural reinforcement. In addition to the shell, parts of various geometric shapes serving different functions can be manufactured by a variety of other methods.

The induction logging tool utilizes an elongate sleeve supported between two end located subs. They are preferably formed by injection molding. The solid body mold is machined to the requisite shape and injection temperatures and pressures are applied to thereby mold the solid part. The preferred form utilizes randomly distributed chopped fibers of the same fiberglass material. They are generally randomly oriented in the flowing, adherent impregnating plastic raised to an appropriate temperature for injection molding. By applying the requisite pressure at the needed elevated temperature, the procedure molds the required shape. By appropriate construction of the cavity in the mold, machining of the formed part is held to a minimum. Typically, machining is required on the sealing surfaces to assure dimensional stability sufficient to enable the subs to be joined to the sleeve.

This invention concerns utilization of the named materials in the fabrication of downhole logging tools for hostile environments. The materials are surprisingly robust at temperatures as high as 260° C. and pressures as high as 170 MPa while exposed to aggressive well fluids including drilling muds and $H_2S$.

The present invention thus includes parts formed by compression molding or by towpreg (a term defined below)

application on a rotating mandrel and finish machining which are combined with appropriate design criteria dictated by the function of the downhole tool design to provide robust HPHT downhole tools. In both instances, the preferred resin is a polyaryletherketone resin with bonded glass fibers. This provides the requisite strength, electrical and magnetic characteristics while withstanding the pressures, temperature and corrosive fluids found in deep wells.

BRIEF DESCRIPTION OF THE DRAWINGS

The advantages of the present invention will become apparent from the following description of the accompanying drawings. It is to be understood that the drawings are to be used for the purpose of illustration only, and not as a definition of the invention.

In the drawings.

DETAILED DESCRIPTION OF THE PREFERRED EMBODIMENTS

Figure 1:
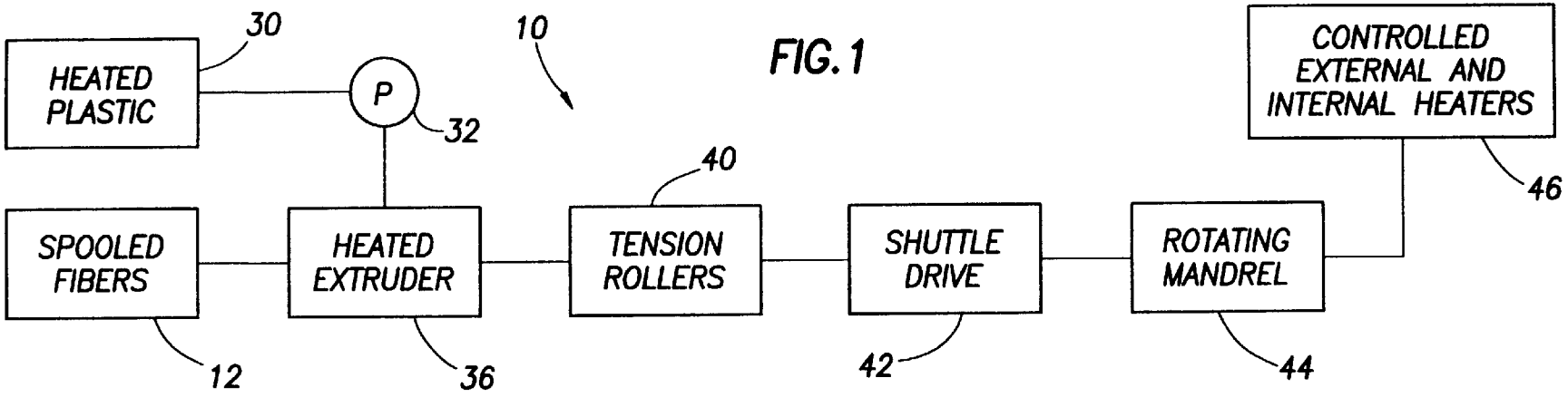
FIG. 1 is a block diagram schematic showing a sequence of manufacturing steps for converting flexible yarn and impregnating resin into a towpreg wrapped on a rotating mandrel for forming an elongate cylindrical housing for an induction logging tool wherein the towpreg is wrapped around the mandrel to form the completed shell.

Attention is directed first to FIG. 1 of the drawings. A method of forming the preferred polyaryletherketone resin is set forth. As a preliminary step to making the multiple ply, multiple layer composite into an elongate tubular shell for a logging tool, a resin impregnated, fiber reinforced member called towpreg is formed. Examples of logging tools will be given later. In FIG. 1, the numeral 10 identifies a towpreg manufacturing and winding line. Several replicated spools of fibers 12 are located so that they direct elongate strands which align the several fibers to form the disclosed towpreg 20. An enlarged view of the towpreg is shown at 20. The towpreg 20 is formed to a specified width and thickness. The thickness is typically in the range of about 0.008" to about 0.02". The width is up to about 0.25". In general terms, it is extruded to form a rectangular cross-section. The shape is defined by a die which provides the requisite rectangular cross-sectional form.

The fibers are preferably a high temperature material provided by Owens Corning Fiberglass and is known as S2 fiberglass. The fiberglass is a high strength magnesium aluminosilicate glass. The glass fibers have a diameter ranging between about 10 and about 40 microns. They are preferably continuous filament, i.e., they are extremely long. Where they are grouped as a number of individual fibers making up an interlaced supply, the individual fibers have finite length but when interlaced, the collective length is substantially indefinite. Several sources of fibers are spooled to provide controllable tension and a desired level of prestress in them.

The class of polyaryletherketones is disclosed in U.S. Pat. No. 4,320,224. Structurally they are semi-crystalline, thermoplastic resins composed of the following repeat units:

$—C_6H_4—$, $—O—$, $—C(O)—$ in which the —O— and —C(O)— units are separated by at least one $—C_6H_4—$ unit.

One type called PEEK is manufactured by Victrex USA, Inc. of West Chester, Pa. and disclosed in U.S. Pat. No. 4,320,224. Its repeat unit is as follows:

$[—C_6H_4—C(O)C_6H_4OC_6H_4O—]_n$ where n is about 100.

Another type called PEKK is marketed by Cytec Fiberite. It has the following repeat unit:

$[—C_6H_4OC_6H_4C(O)C_6H_4(CO)—]_n$ where n is about 100.

A third type called ULTRAPEK was commercialized by BASF and has the repeat unit:

$[—C_6H_4OC_6H_4C(O)C_6H_4OC_6H_4OC_6H_4C(O)C_6H_4C(O)—]_n$ where n is about 50.

The preferred plastic resin of this invention includes the three named resins where PEKK is most preferred. In the preferred embodiment of this invention, fiberglass embedded resin is wound to the desired size and may be later machined if required.

Carbon black, up to about 2%, is added to the selected resin. Carbon black assists in the winding operation by enhancing heat absorption. It also reduces UV degradation in the finished product. Electrical properties are not degraded by a small amount of carbon granules. The selected resin is supplied at a specified viscosity and heated to an elevated temperature which is sufficient to effectively impregnate the fibers 12. More specifically, this temperature is in the range of at least about 650° F. and the most effective temperature is about 700° F. or slightly there above. The finished product is in the range of about 33 to 43% by weight of resin. The remaining portion is made up of the fiber content 12.

Figure 3:
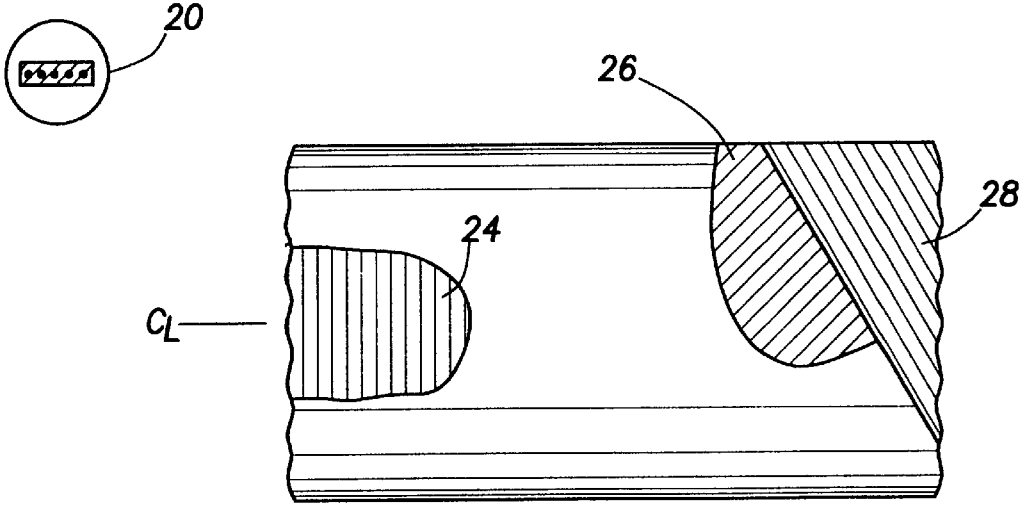
FIG. 3 is a side view of a completed induction logging tool shell with portions broken away to illustrate multiple plies which form the shell and provide strength for it.
Figure 2:
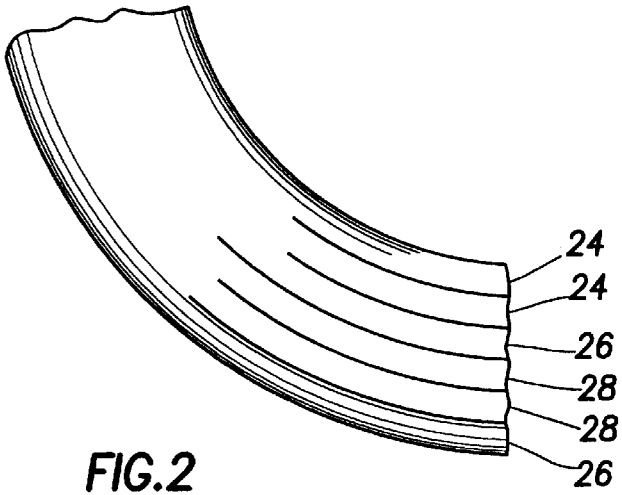
FIG. 2 is an enlarged end view of a completed shell showing a portion of the wall and showing how it is formed of multiple layers of towpreg.

The selected resin 30 is delivered by a pump 32 along with the fibers 12 to a heated extruder 36. The towpreg 20 is guided over tension rollers 40 to a shuttle drive 42 for winding on a rotating mandrel 44. Several adjacent heaters 46 apply heat externally and internally as needed to enable the tensioned member 20 to form a "unitary" member from multiple windings in multiple plies. FIGS. 2 and 3 show different plies around a mandrel shaping an elongate cylinders. This includes one or more bottom plies 24 having no bias angle, and plies 26 and 28 with bias angles in opposite directions. The outer ply 26 has essentially no bias angle. The representative shell, made to length and thickness, is described below on the logging tool.

THERMOPLASTIC COMPOSITE CONSTRUCTION

There exist several different processes for the construction of continuous fiber-reinforced composite articles. These include filament winding, compression molding of stacked sheets, and resin transfer molding. For polyaryletherketone resins like the ones claimed herein, the most preferred method is filament winding. The first step is to impregnate S2 fiberglass tow with the resin as described for example in U.S. Pat. No. 4,549,920. The tow comprises a plurality of filaments, the filaments having a diameter preferably up to 24 microns. The tensioned tow is passed continuously through a heated nip at which point it is spread and molten resin is injected so as to substantially completely wet all the filaments with resin. The impregnated tow, called towpreg, has the form of flat tape. It is then traverse wound on a rotating mandrel from a traversing carriage as described for example in U.S. Pat. No. 5,160,561. Consolidation is achieved by appropriate heating to melt each successive ply so that it fuses to the previous ply before cooling and solidifying. The resulting monolithic structure has all the properties required of a shell for a downhole logging tool.

Plies are added at an angle (from the axis of the mandrel) which can vary between 0 and 90°. Mechanical properties in the x, y and z directions depend on the angular construction which is therefore specified according to engineering requirements. Typical downhole logging tools require tubular shapes with diameters ranging from 2 to 20 cm., wall thicknesses from 0.2 to 2 cm. and lengths up to six meters. The filament winding process described above is well-suited to produce tubular shapes having these dimensions.

PROPERTY AND TEST DATA

Before this invention, shells for downhole logging tools rated to 260° C. comprised a thermoset phenolic resin reinforced with fiberglass fabric. Shells were fabricated by impregnating woven glass fabric with a phenolic resin to give a prepreg. The prepreg was wrapped around a mandrel to the desired thickness then cured under heat and pressure. The resulting thermoset composite shells were extremely unreliable; sometime they performed as designated but more often they failed by cracking.

Shells were certified by immersing them in water at 270° C. and 179 MPa hydrostatic pressure for a few hours in a high pressure well. A high percentage of shells failed during a single excursion in a test well. Shells which survived the well test often failed after a single well-logging job. Failures were traced to internal defects caused by the shrinkage of the resin during curing. The thermoplastic composite shells of this invention do not have this disadvantage and therefore do not fail in well tests.

Another way to compare composite shells is to test their properties before and after well tests. To that end a method was developed to measure "ring flexural properties". One-inch rings sliced from shells were compressed diametrically between opposing flat platens of a test machine until failure. From the stress/strain curve it is possible to calculate the modulus and strength of rings using published formulas.

A series of tests were conducted in which rings were exposed in water or oil at temperatures ranging from 176 to 260° C. and pressures to 179 Mpa for periods up to 12 hours. Representative rings were subjected to the ring flexural tests before and after exposure. Phenolic/fiberglass rings showed excessive losses in ring flexural strength. In a typical test, flexural strength declined from 140 MPa to 78.6 Mpa after only one hour at 232° C. and one hour at 260° C.

For comparison, filament-wound rings made of fiberglass-reinforced PEKK resin were tested but under more severe conditions. After six hours in water at 270° C. and 145 Mpa pressure the ring flexural strength was 206 Mpa and the flexural modulus was 36 Gpa.

MOLDED COMPONENTS

Random lengths of chopped fiberglass are randomly mixed with the preferred resin, and are injected at appropriate temperature and pressure by an injection molding machine into a mold to define a shaped sub. As before, up to about 2% of carbon black distributed throughout the resin is permissible. The fibers are more or less randomly oriented. The fibers provide significant structural integrity and modify the CTE somewhat. They can comprise about 30% or 40% by weight of the mixture. After injection molding, a component is provided having desirable characteristics which will become more apparent on discussion of typical applications in a well borehole below.

LOGGING TOOL CONSTRUCTION

Figure 4:
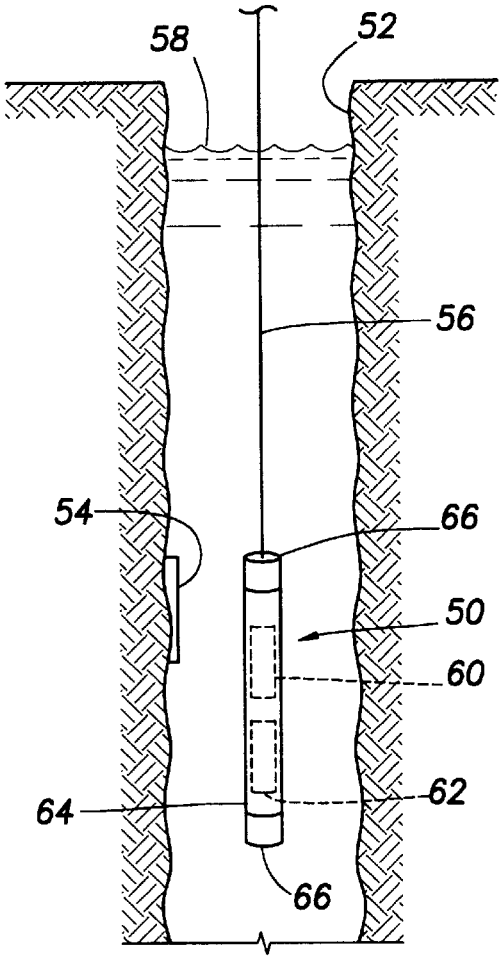
FIG. 4 shows a wireline supported logging tool.

Attention is directed to FIG. 4 of the drawings which illustrates a wireline supported logging tool in an open hole filled with fluid. By contrast, FIG. 5, to be discussed below, shows a logging tool appended to a drill stem. As will be understood in both circumstances, the holes are shown vertical which is certainly not always the prevalent situation. Commonly, the well will be drilled vertically at the surface and deviated at angles from the vertical. By gravity, the logging tool 50 of the present disclosure is lowered into the well borehole 52. While part of the well may be cased, it has been omitted at the portion of the well adjacent to the logging tool 50 to show the typical circumstances. The drilled hole is rugose. Mud cake 54, a portion shown adjacent the tool 50, will build up on the borehole wall which somewhat reduces the abrasive nature of the borehole. Nevertheless, the rugose condition of the borehole abrades the exposed surfaces of the logging tool 50 suspended on the wireline 56. In this context, the tool may drag against the side; based on the weight of the tool, the angle of the well and other factors which are highly variant, some abrasive damage will accumulate. In general terms, the tool is lowered to the depth desired for the logging to be accomplished and retrieved. It is lowered in the column of fluid 58 standing in the well borehole. Again, FIG. 4 has been simplified but provides a relatively simple context in which the logging tool is exposed to HPHT in the presence of highly caustic fluid. There may be $H_2S$ present, perhaps entrained in the well fluid 58. The logging tool 50 incorporates some type of formation irradiation device 60, and a matched responsive sensor 62. The device 60 can be one or more coils in an array forming an induced EMF field in the adjacent formation. That typically is denoted as a transmitter coil (meaning one or more). The sensor 62, in that instance, is denoted as a receiver coil (one or more) and thus the coil system makes inductive logging measurements in the formations. Another example is a neutron generator which transmits neutrons into the formation and the sensor 62 would then be a radiation detector such as a NaI detector. Without regard to the particular irradiation device 60, the matched sensor 62 receives and responds appropriately and forms a logging signal useful in determining the nature of the formations along the well borehole. The logging tool of this disclosure incorporates the shell 64 which is mounted between a pair of end located subs 66. The shell is formed in the manner disclosed above to thereby house the operative components of the logging tool. The hollow shell is mounted on appropriate end located subs 66 which are made by injection molding using the preferred resin of this disclosure. The surfaces of the shell 64 and the subs 66 are formed of the preferred resin fabricated as set forth above.

Figure 5:
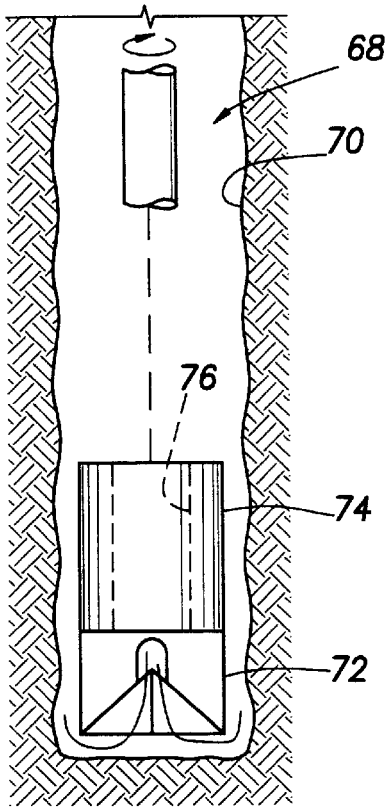
FIG. 5 shows a drill stem supported logging while drilling tool.
Figure 6:
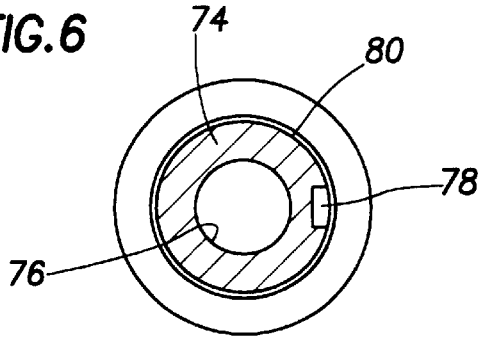
FIG. 6 is a sectional view of the tool of FIG. 5.

FIG. 5 shows an alternate logging system. In FIG. 5, a logging while drilling system is disclosed. This involves a drill stem 68 suspended in a well borehole 70 for continued drilling. The drill stem 68 includes an appropriate length of drill pipe extending from a kelly at the surface with rotation imparted in the illustrated direction. At the lower end of the drill stem, a drill bit 72 advances the hole in response to rotation. Several drill collars 74 are incorporated. The drill collars are pipe joints with extra thick walls to enhance stiffness and weight, thereby maintaining the hole relatively straight. Mud is pumped down through the drill stem, flowing through the internal passage 76 in the drill collar 74 and out through the drill bit 72 and is returned to the surface in the annular space on the exterior of the drill stem. The drill stem includes one or more conventional drill collars 74. Of important significance to the present disclosure, preferably the lowermost drill collar includes logging while drilling (LWD) apparatus. The significance of the present invention to the LWD system is brought out better in FIG. 6. There, the drill collar 74 is provided with a chamber 78 to enclose a measuring instrument. The measuring instrument can be the same instruments incorporated at 60 in FIG. 4. More specifically, some type of irradiation device and sensor are included, both being mounted in the chamber 78. In actuality, there may be several such chambers along the drill collar 74. The chambers are located so that they do not materially weaken the drill collar. In general terms, the radiation is directed outwardly in the form of a beam or fully encircles the well borehole. An induction logging tool exemplifies a measuring system extending radially outwardly around the well borehole. In any event, the operative equipment for the measuring system is mounted and protected in the chamber 78, and the sleeve 80 is positioned around that. The sleeve 80 is constructed in accordance with the teachings of the present disclosure. Thus, the sleeve 80 is transparent to the radiation including EMF at any desired frequency. In addition, it isolates the chamber 78 from the fluids in the well. The fabricated cylindrical housing 80 is constructed in accordance with this disclosure. It has the advantages of operating at significant HPHT and yet is transparent to the EMF transmitted into the formations.

Figure 7:
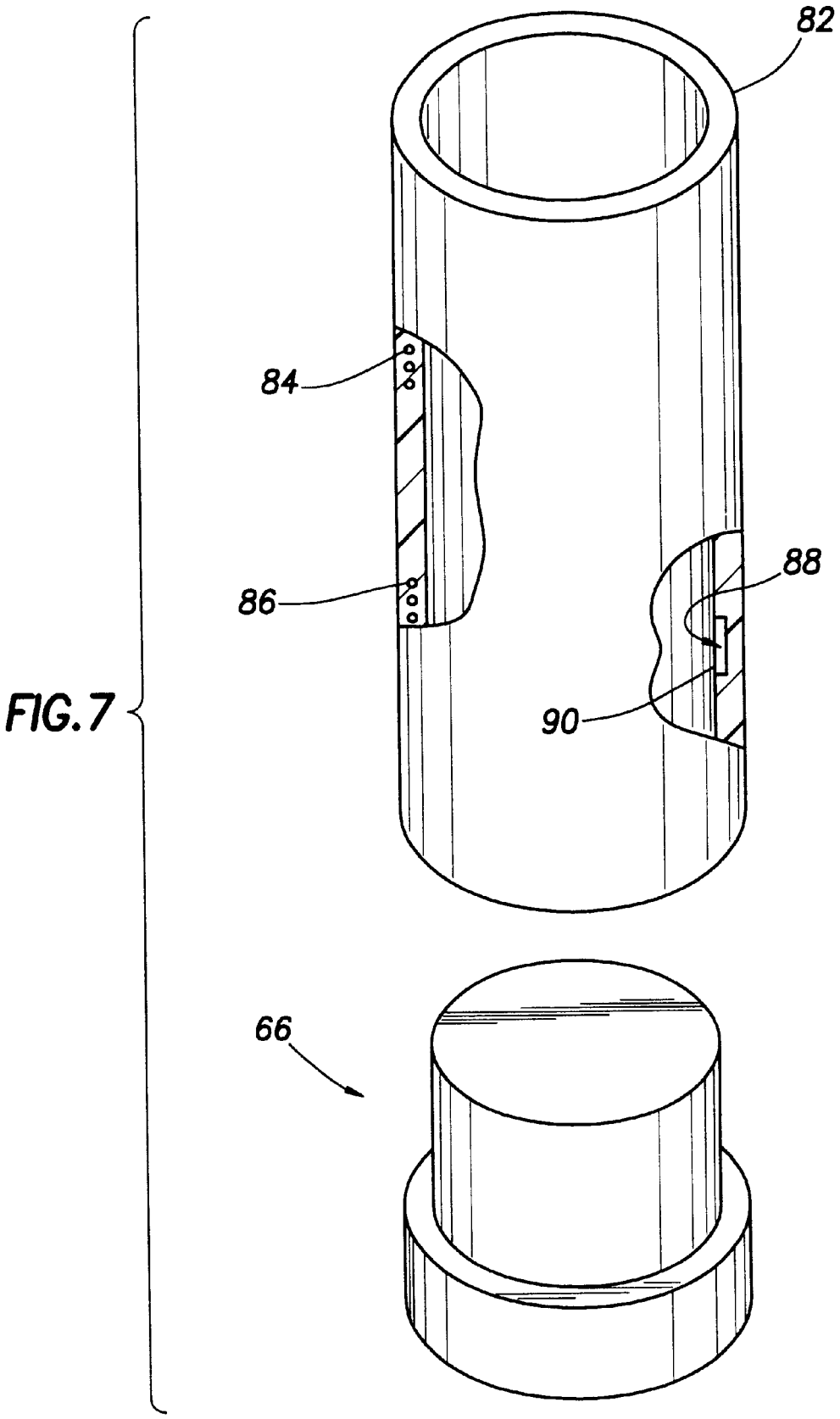
FIG. 7 is an isometric view through a sleeve showing a coil array supported by the sleeve.

Attention is now directed to FIG. 7 of the drawings which shows a modified shell in accordance with this disclosure. The modified shell 82 and end located sub 66 shown in FIG. 7 are aptly used in a logging tool 50. A portion of the wall has been broken away to show, in cross-sectional view, shell construction. The shell or sleeve 82 is constructed with a first coil 84 wound within the wall thickness. A second coil 86 is spaced from it. It is also integrally fabricated in the wall. Again, one or more coils make up an induction logging tool transmitter and receive coil array. As representative dimensions, the wall might be about 0.50 inch in thickness and encloses one or more turns of the coils 84 and 86 in the wall. The gauge of wire is appropriate for the requirement. One or more turns make up each of the coils 84 and 86. As an example, the coil 84 is the transmitter coil and the coil 86 is the receiver coil for an induction logging array. As required, the coils making up the array can be partially or wholly embedded in the wall. FIG. 7 additionally shows an internal recess 88 in the wall which recess mounts internally a sensor 90 which is responsive to the EMF or other irradiation triggered response back to the logging tool. Accordingly, the sensor can be on the inside surface, recessed or flush mounted as illustrated, and can also protrude above the inside surface. Both integrally formed sensors can be incorporated as well as those which are mounted after manufacture. The sensor construction shown in FIG. 7 can be deployed either in the wireline tool 50 of FIG. 4 or the LWD tool in FIG. 5.

While the foregoing is directed to the preferred embodiment, the scope is determined by the claims which follow:

What I claim is:

1. A downhole logging tool comprising a signal source for irradiating a subsurface formation and a housing which protects said signal source, the housing comprises a shell of polyaryletherketone thermoplastic resin.

2. The housing of claim I wherein said resin is a linear aromatic polymer having the following repeat units:

$—C_6H_4—$, —O—, —C(O)— in which —O— (ether) and —C(O)— (ketone) units are separated by at least one $—C_6H_4—$ (arylene) unit.

3. The housing of claim 2 wherein said shell is a fiber reinforced composite including an elongate cylindrical fiber sleeve.

4. The housing of claim 3 including multiple plies of said fiber in said resin wherein said plies have specified angular bias positions.

5. The housing of claim 4 wherein said shell comprises a specified wall thickness of said resin; and said fibers are fiberglass.

6. The housing of claim 2 wherein a material which enhances heat absorption and reduces UV degradation of said shell is added to said resin.

7. The housing of claim 6 wherein the material is carbon black.

8. The housing of claim 1 wherein said logging tool positions said signal source and a signal sensor within said housing.

9. The housing of claim 8 wherein said signal sensor and signal source are concentric within said housing.

10. A logging tool comprising a sensor responsive to signals from a subsurface formation and a sub supported external shell about said sensor, the sub supported shell comprising polyaryletherketone thermoplastic resin.

11. The logging tool of claim 10 wherein said sub supported shell comprises an elongate hollow cylindrical shell connected to a sub at an end thereof.

12. The logging tool of claim 11 wherein said sub comprises a circular sub connected at one end of said shell and fits concentrically thereto.

13. The logging tool of claim 11 wherein said sub comprises a molded solid body reinforced by plural, discontinuous fibers.

14. The logging tool of claim 10 wherein said sub supported shell comprises an elongate, cylindrical, multiple ply, fiberglass reinforced sleeve fully integral with said shell.

15. The logging tool of claim 14 wherein said logging tool shell comprises a unitary body of said thermoplastic material and said material is a thermoplastic resin from the group consisting of $[—C_6H_4—C(O)C_6H_4O\ C_6H_4O—]_n$ where n is about 100;

$[—C_6H_4OC_6H_4C(O)C_6H_4(CO)—]_n$ where n is about 100;

$[—C_6H_4OC_6H_4C(O)C_6H_4OC_6H_4OC_6H_4C(O)C_6H_4C(O)—]_n$ where n is about 50; or mixtures thereof.

16. The logging tool of claim 10 wherein said shell surrounds a cable supported signal sensor.

17. The logging tool of claim 10 wherein said shell surrounds a drill collar.

18. The logging tool of claim 17 wherein said shell encloses and surrounds said sensor mounted on said drill collar.

19. The logging tool of claim 18 wherein said shell is concentric around said drill collar.

20. The logging tool of claim 10 wherein said shell supports said sensor internally thereof.

21. The logging tool of claim 20 wherein said sensor is a coil mounted on said shell.

22. An elongate shell for use in a well borehole comprising an elongate, hollow, cylindrical shell of polyaryletherketone resin, and a sensor supported thereby wherein said shell protects said sensor from borehole fluids.

23. The shell of claim 22 wherein said sensor is mounted on a cylindrical face of said shell.

24. The shell of claim 22 wherein said shell is formed to a specified wall thickness and said sensor is embedded therein.

25. The shell of claim 22 wherein said sensor comprises a plurality of coils and each coil has multiple turns concentric with said shell.

* * * * *